US010371335B2

(12) United States Patent
Zorn et al.

(10) Patent No.: US 10,371,335 B2
(45) Date of Patent: Aug. 6, 2019

(54) LIGHTING MODULE FOR A VEHICLE HEADLAMP

(71) Applicant: ZKW GROUP GMBH, Wieselburg (AT)

(72) Inventors: Jürgen Zorn, Rossatz (AT); Thomas Edletzberger, Loosdorf (AT); Christian Bemmer, Klein-Poechlarn (AT); Peter Schadenhofer, Roggendorf (AT); Martin Schragl, Zarnsdorf (AT); Martin Stein, Zarnsdorf (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 15/738,340

(22) PCT Filed: Jun. 9, 2016

(86) PCT No.: PCT/AT2016/050189
§ 371 (c)(1),
(2) Date: Dec. 20, 2017

(87) PCT Pub. No.: WO2017/000005
PCT Pub. Date: Jan. 5, 2017

(65) Prior Publication Data

US 2018/0180239 A1 Jun. 28, 2018

(30) Foreign Application Priority Data

Jun. 30, 2015 (AT) ..... A 50573/2015

(51) Int. Cl.
*F21S 41/20* (2018.01)
*F21S 41/14* (2018.01)
(Continued)

(52) U.S. Cl.
CPC ..... *F21S 41/285* (2018.01); *F21S 41/14* (2018.01); *F21S 41/16* (2018.01); *F21S 41/176* (2018.01);
(Continued)

(58) Field of Classification Search
CPC ..... F21S 41/285; F21S 41/24; F21S 41/28; F21S 41/178; F21S 41/176; F21S 41/14; F21S 41/16; F21S 41/255
See application file for complete search history.

(56) References Cited

U.S. PATENT DOCUMENTS

2005/0207162 A1 9/2005 Komatsu
2011/0279007 A1 11/2011 Kishimoto
(Continued)

FOREIGN PATENT DOCUMENTS

DE 102012206970 A1 10/2013
DE 102013200521 A1 7/2014
(Continued)

OTHER PUBLICATIONS

International Search Report and Written Opinion for PCT/AT2016/050189, dated Oct. 6, 2016 (12 pages).
(Continued)

*Primary Examiner* — Anabel Ton
(74) *Attorney, Agent, or Firm* — Eversheds Sutherland (US) LLP

(57) ABSTRACT

A lighting module (1) for a vehicle headlamp (2), wherein the lighting module (1) comprises at least one lighting element (3), which is excitable to emit visible light when illuminated by laser light, and at least one light-transmissive carrier element (4), wherein the carrier element (4) has at least one light-entry face (4*a*) and at least one light-exit face (4*b*) lying opposite the light-entry face (4*a*), wherein the at least one lighting element (3) is arranged at the at least one
(Continued)

Figure 1:
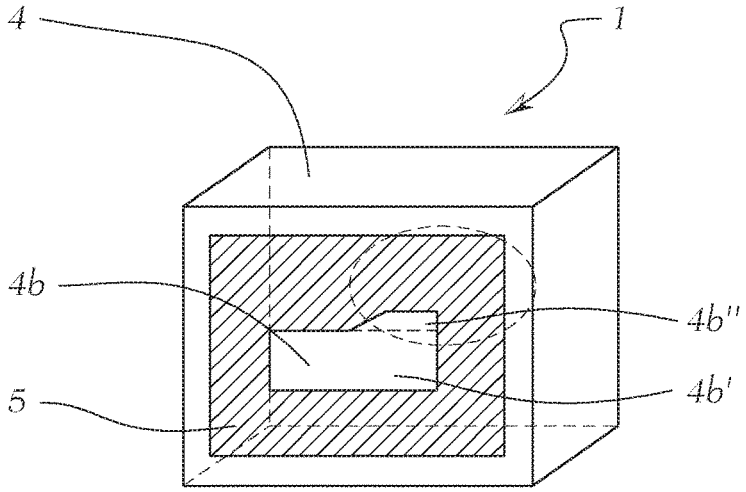

light-entry face (4*a*) of the carrier element (4) in order to radiate light into the light-entry face (4*a*), wherein a) the at least one light-exit face (4*b*) of the carrier element (4) is delimited by a light-opaque mask (5) surrounding the light-exit face (4*b*) or b) the at least one light-exit face (4*b*) reaches up to the side faces (6*a* to 6*d*) of the carrier element (4), wherein at least one side face (6*b*) has two side portions (6*b'*, 6*b*") adjoining one another, said side portions being inclined relative to one another for forming a light/dark boundary.

10 Claims, 3 Drawing Sheets

(51) Int. Cl.

| | |
|---|---|
| ***F21S 41/24*** | (2018.01) |
| ***F21S 41/255*** | (2018.01) |
| ***F21S 41/47*** | (2018.01) |
| ***F21S 41/16*** | (2018.01) |
| ***F21S 41/176*** | (2018.01) |

(52) U.S. Cl.
CPC ..... *F21S 41/24* (2018.01); *F21S 41/255* (2018.01); *F21S 41/28* (2018.01); *F21S 41/47* (2018.01)

(56) References Cited

U.S. PATENT DOCUMENTS

| | | | | |
|---|---|---|---|---|
| 2014/0169024 | A1 | 6/2014 | Hager et al. | |
| 2015/0023037 | A1 | 1/2015 | Bauer et al. | |
| 2016/0084462 | A1 | 3/2016 | Suwa et al. | |
| 2016/0265733 | A1* | 9/2016 | Bauer ..... | G02B 3/0006 |

FOREIGN PATENT DOCUMENTS

| | | | |
|---|---|---|---|
| EP | 2068068 | A2 | 10/2009 |
| EP | 2597735 | A2 | 5/2013 |
| JP | 2000003605 | A | 1/2000 |
| JP | 2009238615 | A | 10/2009 |
| JP | 2011222260 | A | 11/2011 |
| JP | 2012-009381 | A | 1/2012 |
| JP | 2013-030453 | A | 2/2013 |
| JP | 2013-196818 | A | 9/2013 |
| JP | 2013-242996 | A | 12/2013 |
| JP | 2015-088283 | A | 5/2015 |
| WO | 2012/005686 | A1 | 1/2012 |

OTHER PUBLICATIONS

Office Action issued in Austrian Application No. A 50573/2015, dated Jun. 1, 2016 (3 pages).

* cited by examiner

LIGHTING MODULE FOR A VEHICLE HEADLAMP

The invention relates to a lighting module for a vehicle headlamp, wherein the lighting module comprises at least one lighting element, which is excitable to emit visible light when illuminated by laser light, and at least one light-transmissive carrier element, wherein the carrier element has at least one light-entry face and at least one light-exit face lying opposite the light-entry face.

Lighting modules according to the prior art which have a lighting element which is excitable to emit visible light using laser light have the disadvantage that the light irradiated by the lighting element is generally undirected and has to be positioned or shaped in relation to a downstream optical system by means of additional components.

The object of the invention is therefore to overcome this disadvantage. This object is achieved with a lighting module of the type described in the introduction, in which, in accordance with the invention, the at least one lighting element is arranged at the at least one light-entry face of the carrier element in order to radiate light into the light-entry face, wherein a) the at least one light-exit face of the carrier element is delimited by a light-opaque mask surrounding the light-exit face or b) the at least one light-exit face reaches up to the side faces of the carrier element, wherein at least one side face has two side portions adjoining one another, said side portions being inclined relative to one another for forming a light/dark boundary.

In an embodiment according to point b), the inclination of the side faces could be between 15° and 90°. Within the scope of this disclosure, the term "laser light" is understood to mean a light irradiated from a laser light source with a wavelength between 550 and 200 nm. Blue light with a wavelength of approximately 450 nm is preferably used. For example, the lighting element can be a phosphor.

It can be provided advantageously that the carrier element is made of glass.

In particular, it can be provided that the at least one light-entry face and the at least one light-exit face are parallel to one another.

In addition, it can be provided that the ratio of the light-entry face to the light-exit face is between 1:1 and 1:10, the ratio of the value of the light-exit face measured in $mm^2$ to the value of the distance between the light-entry and light-exit face measured in mm is less than 2:1, and the ratio of the value of the light-entry face measured in $mm^2$ to the value of the distance between the light-entry and light-exit face measured in mm is less than 1:2. In the event of a main beam application, a light image with angular width of +/−5° is typically sufficient. With a typical lens focal distance of 40 mm, this would mean an extension in the image plane of 10 mm. If the focal distance decreases, this value also becomes smaller, however the intensities that can be achieved are also reduced. In order to achieve maximum intensities for the use of the lighting module as main beam, it makes sense for the light spot, i.e. the region of the lighting element excited by laser light, to be very small (0.1 mm<D<1 mm) and thus concentrated, and additionally to choose the distance between the light-entry and light-exit face to be large in order to shadow the interfering yellow colouring at the edge of the angular region. In order to implement the function expediently, there is a minimum distance between the light-entry and light-exit face of 10 mm, and although with greater distances the light use efficiency of the system reduces, the maximum intensity that can be achieved is increased. With an application for homogeneous illumination, in which there is no need for high intensities, it is expedient to use a larger light spot (1 mm<D<10 mm). Here, the distance between the light-entry and light-exit face can also be less than 10 mm. However, there are also applications where a large distance is used for homogenisation of the illumination. What are known as integrator bars (light-entry and light-exit faces typically identical, distance very great) can be used to combine light bundles from various light sources so as to form an individual light bundle that is as homogeneous as possible.

In addition, it can be provided that the carrier element is a plane-parallel plate which preferably has a thickness of at least 0.2 mm.

In particular, it can be provided that the mask is formed of a lacquer coating, a polymer or a metal coating. A mask formed of a metal coating forms a reflective area, which in particular has advantages in high-energy applications, since a coating of this kind is particularly robust. In order to image a light-dark boundary directly at the carrier element, it can be provided that the mask limits the light-exit face to a substantially six-sided geometric shape, which is formed of a rectangular area and a trapezoid area sitting on one half of the rectangular area, wherein a side line of the trapezoid area extends in line with a side line of the rectangular area. The inclination of the side line of the trapezoid area lying opposite the side line extending in line is for example between 15 and 90°.

A further aspect of the invention relates to a vehicle headlamp comprising a lighting module according to the invention and a laser light source for exciting the lighting module or lighting element.

In particular, it can be provided that the vehicle headlamp also has a projection lens, in particular an aspherical projection lens, for imaging the light emitted by the lighting module into a region disposed in front of the vehicle headlamp.

Here, it can be favourable if the at least one light-exit face of the lighting module has a course adapted to the curvature of the field of view of the projection lens. It is thus possible that each point at the light-exit face is imaged with the same geometrical properties by the lens, whereby aberrations can be avoided.

Figure 2:
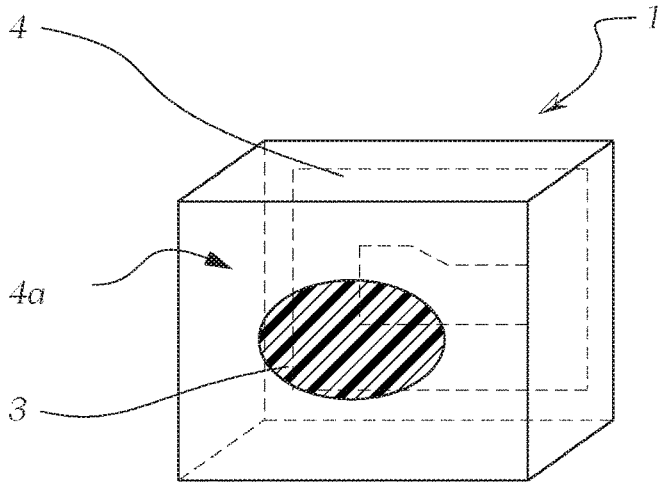
Figure 3:
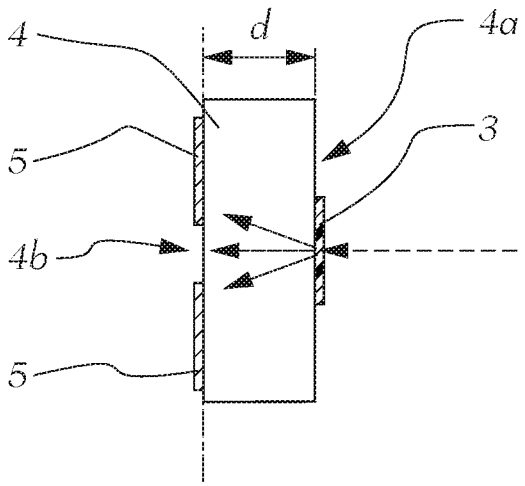
Figure 4:
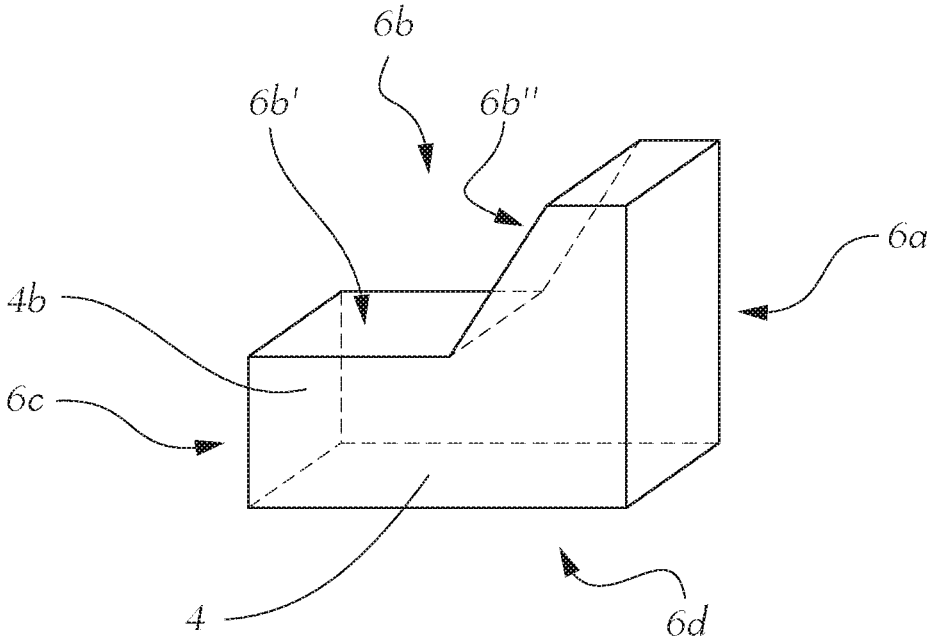
Figure 5:
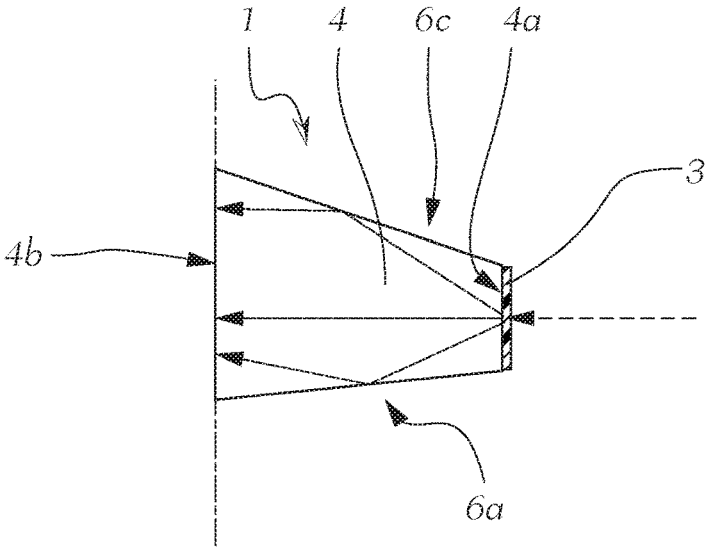
Figure 6:
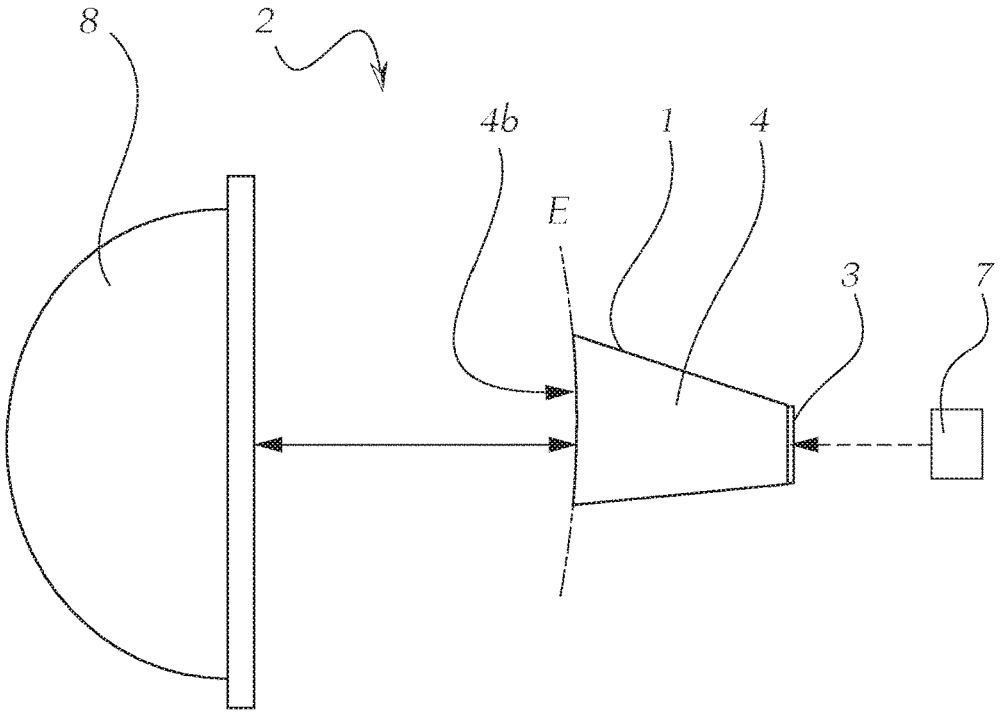

The invention will be explained in greater detail hereinafter on the basis of exemplary and non-limiting embodiments, which are illustrated in the drawings, in which FIG. 1 shows a front view of a first embodiment of a lighting module according to the invention, FIG. 2 shows a rear view of the lighting module from FIG. 1, FIG. 3 shows a side view of the lighting module according to FIGS. 1 and 2, FIG. 4 shows a perspective illustration of a second embodiment of a lighting module, FIG. 5 shows a schematic plan view of the lighting module according to FIG. 4, and FIG. 6 shows a schematic illustration of a vehicle headlight comprising a lighting module according to the invention.

Unless stated otherwise, like reference signs denote like features in the following exemplary embodiments.

FIG. 1 shows a front view of a first embodiment of a lighting module 1 according to the invention. A lighting module 1 for a vehicle headlamp 2 illustrated in FIG. 6 can be seen, wherein the lighting module 1 comprises at least one lighting element 3 which is excitable to emit visible light when illuminated by laser light. The lighting element 3 is arranged on the rear side (shown in FIG. 2) of a light-transmissive carrier element 4, on which a light-entry face 4*a* is formed, wherein the lighting element 3 radiates light into the carrier element 4 via the light-entry face 4*a*. The front side of the carrier element 4 shown in FIG. 1 has a light-exit face 4*b* lying opposite the light-entry face 4*a*, which light-exit face is surrounded and thus delimited in the shown exemplary embodiment by a light-opaque mask 5. For example, the mask 5 can be formed of a lacquer coating, a polymer, or a metal coating. The mask 5 limits the light-exit face 4*b* to a substantially six-sided geometric shape, which is formed of a rectangular area 4*b*' and a trapezoid area 4*b*" resting on one half of the rectangular area, wherein a side line of the trapezoid area 4*b*" extends in line with a side line of the rectangular area 4*b*'. A light-dark boundary can thus be formed in a simple manner already directly at the light-exit face 4*b* of the lighting module 1.

FIG. 3 shows a side view of the lighting module 1 according to FIGS. 1 and 2. The light-entry face 4*a* and the light-exit face 4*b* are preferably parallel to one another. The thickness d of the carrier element 4 is preferably at least 0.2 mm.

FIG. 4 shows a perspective illustration of a second embodiment of a lighting module 1. In contrast to the first embodiment, the lighting module 1 does not have a mask 5. The carrier element 4 is shaped such that the light-exit face 4*b* reaches as far as the side faces 6*a* to 6*d* of the carrier element 4, wherein at least one side face 6*b* has adjacently arranged side portions 6*b*' and 6*b*", which are inclined relative to one another in order to form a light-dark boundary. The light-exit face 4*b* is therefore delimited directly by the side faces 6*a* to 6*d*.

FIG. 5 shows a schematic plan view of the lighting module 1 according to FIG. 4. Similarly to the lighting module 1 according to FIGS. 1 to 3, the lighting module 1 in accordance with the second embodiment also comprises a lighting element 3, which emits light into the light-entry face 4*a*. This light can additionally be reflected towards the light-exit face 4*b* via the side faces 6*a* to 6*d*, which are reflective. It is thus possible to make the light-entry face 4*a* smaller than the light-exit face 4*b*.

FIG. 6 shows a schematic illustration of a vehicle headlamp 2 with a lighting module 1 according to the invention. The vehicle headlamp 2 comprises a lighting module 1 according to the invention, a laser light source 7 for exciting the lighting module 1, and a projection lens 8 for imaging the light emitted by the lighting module 1 into a region disposed in front of the vehicle headlamp 2. The light-exit face 4*b* advantageously has a shape adapted to the curvature E of the field of view of the projection lens 8, so that light is imaged at any point at the light-exit face 4*b* with the same imaging properties by the projection lens 8.

In consideration of this teaching, a person skilled in the art is able to arrive at other embodiments of the invention (not presented) without exercising inventive skill. The invention is therefore not limited to the presented embodiments. Individual aspects of the invention or the embodiments can also be selected and combined with one another. What are essential are the concepts forming the basis of the invention, which can be implemented in many ways by a person skilled in the art in the knowledge of this description, yet maintained in essence.

The invention claimed is:

1. A motor vehicle headlamp (2) comprising:

a laser light source (7); and a lighting module (1) which comprises:

at least one lighting element (3), which is configured to be excited by the laser light source (7) to emit visible light when illuminated by laser light of the laser light source, and at least one light-transmissive carrier element (4), wherein the at least one light-transmissive carrier element (4) has at least one light-entry face (4*a*) and at least one light-exit face (4*b*) lying opposite the at least one light-entry face (4*a*), wherein the at least one lighting element (3) is arranged at the at least one light-entry face (4*a*) of the at least one light-transmissive carrier element (4) in order to radiate light into the at least one light-entry face (4*a*), wherein:

a) the at least one light-exit face (4*b*) of the at least one light-transmissive carrier element (4) is delimited by a light-opaque mask (5) surrounding the at least one light-exit face (4*b*), or b) the at least one light-exit face (4*b*) reaches up to the side faces (6*a* to 6*d*) of the at least one light-transmissive carrier element (4), wherein at least one side face (6*b*) of the side faces has two side portions (6*b*', 6*b*") adjoining one another, said two side portions being inclined relative to one another for forming a light/dark boundary.

2. The motor vehicle headlamp according to claim 1, wherein the at least one light-transmissive carrier element (4) is made of glass.

3. The motor vehicle headlamp according to claim 1, wherein the at least one light-entry face (4*a*) and the at least one light-exit face (4*b*) are parallel to one another.

4. The motor vehicle headlamp according to claim 3, wherein the ratio of the at least one light-entry face (4*a*) to the at least one light-exit face (4*b*) is between 1:1 and 1:10, the ratio of the at least one light-exit face (4*b*) measured in $mm^2$ to the distance between the at least one light-entry face and the at least one light-exit face (4*b*) measured in mm is less than 2:1, and the ratio of the at least one light-entry face (4*a*) measured in $mm^2$ to the distance between the at least one light-entry face and the at least one light-exit face (4*a*) measured in mm is less than 1:2.

5. The motor vehicle headlamp according to claim 1, wherein the at least one light-transmissive carrier element (4) is a plane-parallel plate which has a thickness of at least 0.2 mm.

6. The motor vehicle headlamp according to claim 1, wherein the light-opaque mask (5) is formed of a lacquer coating, a polymer, or a metal coating.

7. The motor-vehicle headlamp according to claim 1, wherein the light-opaque mask (5) is configured to limit the at least one light-exit face (4*b*) to a substantially six-sided geometrical shape, which is formed of a rectangular area and a trapezoid area sitting on one half of the rectangular area, wherein a side line of the trapezoid area extends in line with a side line of the rectangular area.

8. The motor vehicle headlamp (2) according to claim 1, further comprising a projection lens (8) for imaging light emitted by the lighting module (1) into a region disposed in front of the motor vehicle headlamp (2).

9. The motor vehicle headlamp (2) according to claim 8, wherein the at least one light-exit face (4*b*) of the lighting module (1) has a course (E) adapted to the curvature of the field of view of the projection lens (8).

10. The motor vehicle headlamp (2) according to claim 8, wherein the projection lens (8) is an aspherical projection lens.

* * * * *